US007549820B1

(12) United States Patent
Happel

(10) Patent No.: US 7,549,820 B1
(45) Date of Patent: Jun. 23, 2009

(54) CURB OPENING FILTER

(76) Inventor: Henry Happel, 140 Ruby St., Rockledge, FL (US) 32955

( * ) Notice: Subject to any disclaimer, the term of this patent is extended or adjusted under 35 U.S.C. 154(b) by 0 days.

(21) Appl. No.: 11/984,862

(22) Filed: Nov. 21, 2007

Related U.S. Application Data

(60) Provisional application No. 60/860,948, filed on Nov. 27, 2006.

(51) Int. Cl.
*E03F 5/14* (2006.01)

(52) U.S. Cl. ..... 404/4; 210/163

(58) Field of Classification Search ..... 404/2, 404/4; 210/163
See application file for complete search history.

(56) References Cited

U.S. PATENT DOCUMENTS

| | | | | |
|---|---|---|---|---|
| 4,594,157 | A * | 6/1986 | McGowan | 210/163 |
| 6,010,622 | A * | 1/2000 | Chinn et al. | 210/164 |
| 6,017,166 | A * | 1/2000 | Mossburg, Jr. | 404/5 |
| 6,811,708 | B2 * | 11/2004 | Shaw et al. | 210/747 |
| 7,179,371 | B1 * | 2/2007 | Bistline | 210/163 |
| 7,357,861 | B2 * | 4/2008 | Kelley et al. | 210/163 |

* cited by examiner

*Primary Examiner*—Raymond W Addie
(74) *Attorney, Agent, or Firm*—William M. Hobby, III

(57) ABSTRACT

A curb opening filter apparatus is provided for removably attaching over a curbside opening for a storm drain. The filter apparatus has a frame which can be interconnected with similar frames to adjust for different size storm drain openings. The curb opening filter has a system for vertically attaching a filter apparatus over the curbside opening.

6 Claims, 2 Drawing Sheets

10
11
12
13
14
15
16
17
18
19
20
21
25
26
27
28
30
31
32
33

CURB OPENING FILTER

This application claims the benefit of U.S. Provisional Application No. 60/860,948, filed Nov. 27, 2006.

BACKGROUND OF THE INVENTION

Curbs along paved roads and highways have openings for storm water to run off from the road into the storm drain or sewer and into a retention pond or into a river or stream. It is important to keep trash, debris, sand, oil and other pollutants out of the water entering the storm drain in order to prevent contamination of the rivers, lakes or streams during construction while the road is being repaired and when machinery or the like is being cleaned or serviced in the area. It is necessary to keep trash, sand and debris from going into the drain. To accomplish this, a temporary curb protecting device is put in place and removed when the service is complete. It therefore becomes desirable to have a temporary curb protector that can be rapidly installed and removed and which filters water or liquids passing through the curb opening into the storm drain. This filters the water passing into the curb opening at a lower portion of the curb opening and still allows some open area above the filter covering the curb opening to allow an overflow in the event of a heavy rain storm or rapid accumulation of water. The water can overflow the filter and go into the storm drain to prevent the street from flooding. Sometimes curb openings for storm drains are short and placement of a device is fairly simple but in the case of a long storm drain opening, such curb opening filters have a tendency to bend inward to allow accumulated debris and trash to pass under the filter. The present curb opening filter is designed to prevent this inward bend.

SUMMARY OF THE INVENTION

A curb opening filter apparatus for removably attaching over a curbside opening for a storm drain has a frame having at least one open area therethrough. The frame has two end portions with one or both end portions having a connecting joint member formed thereon for removably connecting one frame to a second frame. A plurality of frames can be connected to expand the curb opening filter for larger curbside openings. A fabric filter mesh covers one side of the frame for filtering solid materials out of the water entering the storm drain. An attaching system is provided for supporting the frame upright over a vertical side curb opening. That includes a frame stiffening post having a pair of fasteners for attaching the post to the frame. The attaching system also includes an elongated strut member having an opening in one end thereof with the frame stiffening post extending through the opening. The frame stiffening post fits loosely in the strut member opening and allows it to tilt and wedge on the post when the strut member other end portion is positioned inside a curb opening against the inside surface. The frame connecting joint member can be a tenon shaped to interlock with a second frame connecting joint member corresponding mortise. The frame may have a tenon formed on one end and a mortise formed on the other so that several frame members can be interconnected, each forming a dovetail type joint. The frame connecting joint member can also have a vertical ridge along one edge for attaching to a vertical groove along one edge of a second frame member.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figures 1, 4, 5:
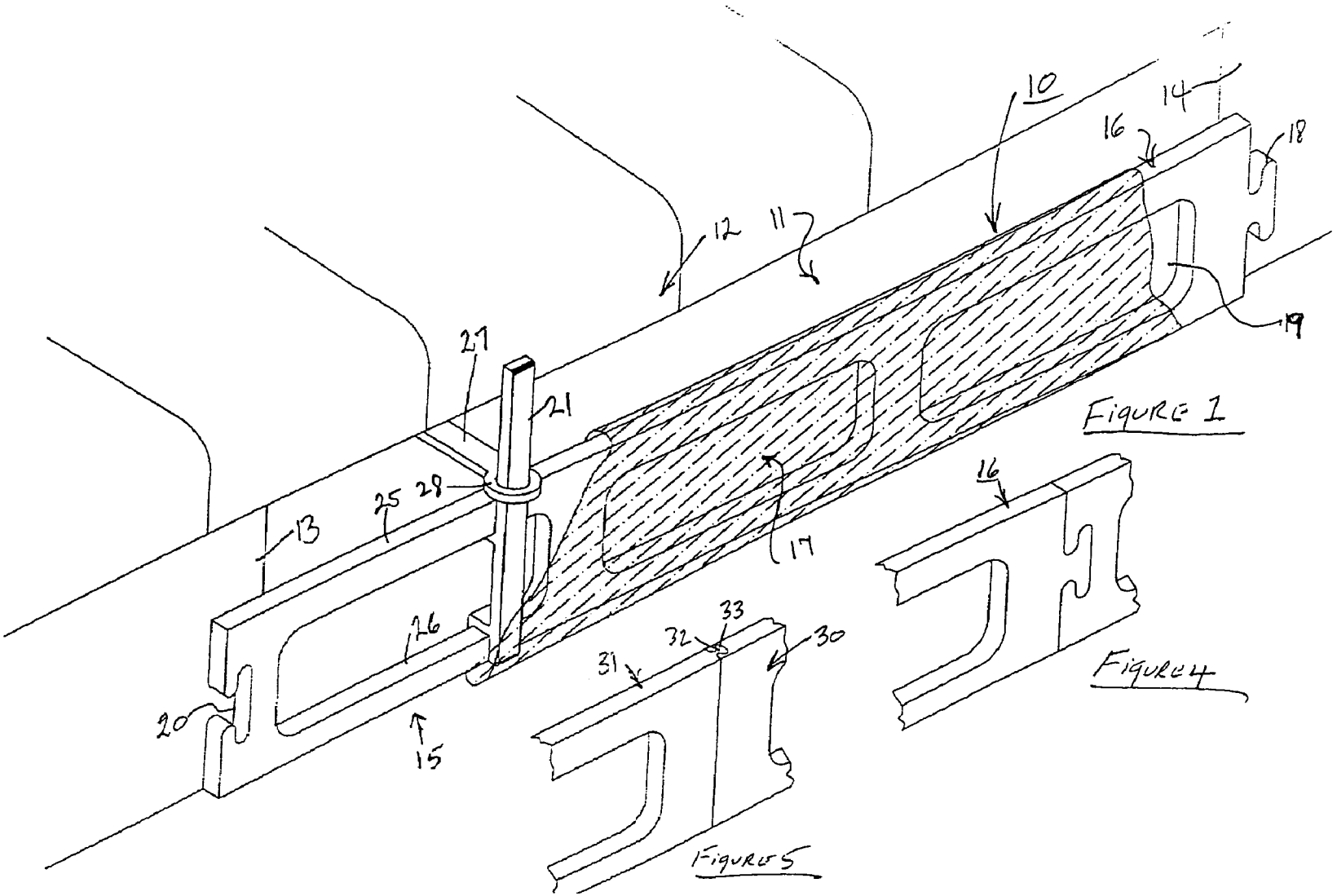
FIG. 1 is a perspective view of a curb opening filter in accordance with the present invention placed over a curb opening.
FIG. 4 is a cut away perspective of the joint connecting two curb filter frames.
FIG. 5 is a cut away perspective of an alternate embodiment of a joint connecting two curb filter frames.
Figure 3:
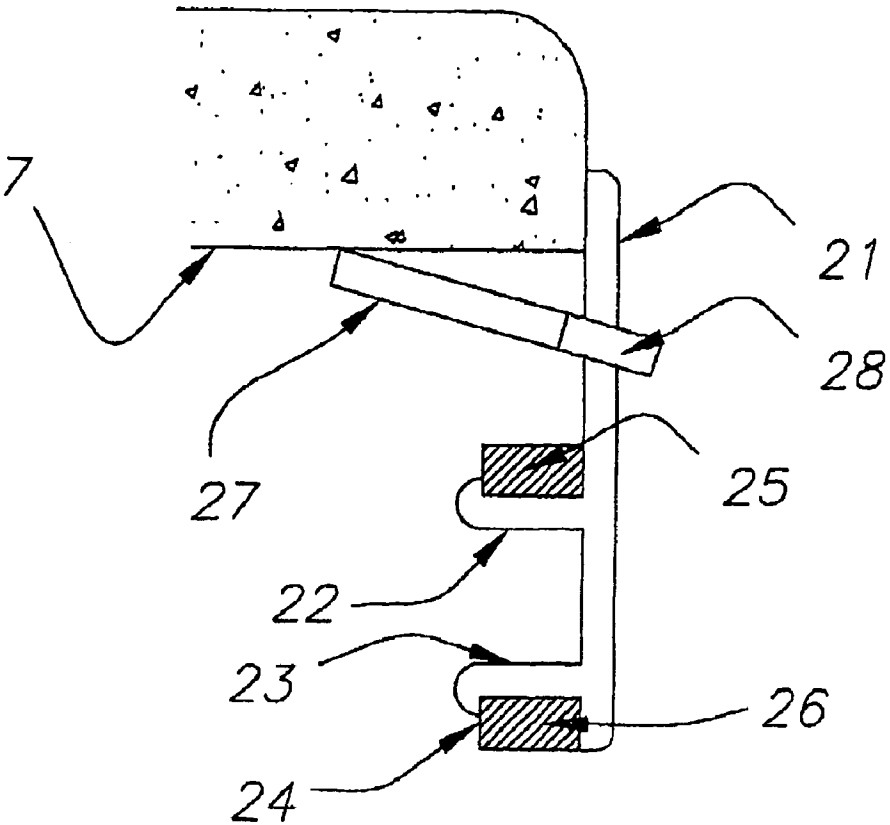
FIG. 3 is a sectional view taken through a curb opening protector of FIG. 1 and attached to the curb.
Figure 2:
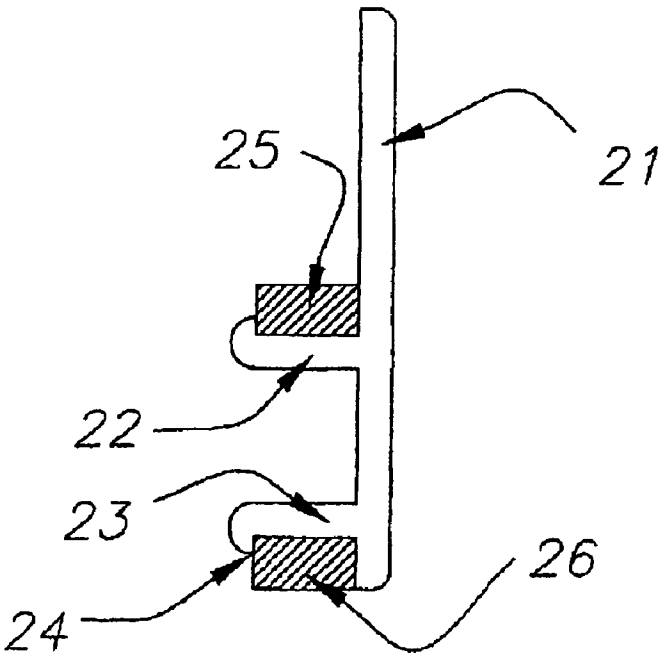
FIG. 2 is a sectional view taken through the frame support of FIG. 1.

Referring to FIGS. 1 through 4 of the drawings, a temporary or semi-permanent curb opening filter is illustrated covering the curb opening 11 for the storm drain or sewer in the curb 12. The curb 12 opening 11 has opening sides 13 and 14 with the street 15 forming the base of the opening 11. The curb opening filter 10 has a framework 16 having open areas 19 to allow for the passage of storm water therethrough when covering the opening 11. The frame 16 is covering with a filter mesh 17 which can be a simple screen or can be covered with a geotextile fabric having a filtered weave high flow monofilament fabric, such as a woven polyethylene fabric. The frame 16 extends over the side edges 13 and 14 and has a connecting joint member 18 on one end with a matching connector 20 on the other end thereof for adding extensions in the manner shown in FIG. 4 to extend the length of the frame 16 for a wider curb opening 11. A frame support post 21 is attached to the frame 16 for providing stiffening to the frame and is easily attached to the frame 16 with a pair of snap fasteners 22 and 23. Each fastener 22 or 23 has a tab 24 on the end thereof for snapping over the frame 16 when the post 21 is attached to the frame 16. The members 23 and 22 are slid between the upper frame member 25 and lower frame member 26 bending the members 22 and 23, which may be made of a polymer, so they slide over the members 25 and 26 to lock the post 21 in place. The post 21 has a horizontal radial torsion strut member 27 attached thereto. The strut member 27 has a circular opening 28 in one end thereof for sliding over the post 21 and extends under the curb 12, as more clearly seen in FIG. 3. The strut 27 is slid under the curb 12. It is positioned to resist torsion forces applied to the bottom of the curb filter 10, frame 16 from the water pressure applied to an elongated frame 16 covering a wide curb opening 11. This prevents a loss of integrity of the curb filter 10 by the water flowing beneath the curb filter 10. It should be noted that the area over the curb filter 10 is opened so that in the event of a heavy rainfall or flooding and the filter portion 17 becoming clogged, the water can still flow over the filter and into the storm drain without flooding the street.

Turning to FIG. 5, an alternate embodiment of a connection for connecting a pair of curb opening filter frames 30 and 31 is illustrated in which a vertically extending enlarged connector portion 32 engages a vertically extending groove 33 in a tongue and groove manner for connecting a pair of curb filter frames.

It should be clear at this time that a temporary or semi-permanent curb filter has been provided which advantageously stiffens or reinforces the curb filter against the forces applied to prevent the frame and snap-in support from rotating to prevent the bottom of the temporary curb filter from pushing in the curb filter. The curb filter filters incoming storm water entering a curb drain opening while allowing a by-pass overflow above the filter in case of a heavy storm. The curb filter 10 is made in snap-together sections for easy storage in a small box for transportation or storage and can be snapped together to any length of curb inlet opening. The curb inlet filter also has a series of supports which apply resistance to the face and underside of a curb to prevent the filter from being washed into the drain. Advantageously, the curb storm water filter 10 can be installed without the use of any tools and can be easily attached and removed as needed. However, the present invention is not to be construed as limited to the forms shown which are to be considered illustrative rather than restrictive.

I claim:

1. A curb opening filter comprising:

at least one frame member, each of said at least one frame member having at least one open area therethrough, and frame having two end portions, at least one end portion having a connecting joint member thereon for removably frame connecting to a second frame member of said at least one frame member;

attaching means for supporting said at least one frame member upright over a vertical side curb opening, said attaching means including a generally vertical frame stiffening post removably attachable to said at least one frame member; and an elongated strut member having an opening in one end thereof loosely fitted over said post thereby allowing said strut member to tilt and wedge thereon when said strut other end portion is positioned inside a curb opening against an inside surface thereof; and a fabric filter mesh covering one side of said at least one frame member;

whereby a curb opening filter can be removably attached over a curbside opening for a storm drain.

2. The curb opening filter in accordance with claim 1 in which said frame connecting joint member is a tenon shaped to interlock with a second frame connecting joint member corresponding mortise.

3. The curb opening filter in accordance with claim 1 in which said frame connecting joint member on one end portion is a tenon and on the other end portion is a mortise each shaped to interconnect with a second frame member.

4. The curb opening filter in accordance with claim 1 in which one end portion of said frame connecting joint member forms a dovetail joint with a second frame connecting joint member.

5. The curb opening filter in accordance with claim 1 in which one end portion of said frame connecting joint member forms has a vertical ridge that slidable attaches to a vertical groove of a second frame member.

6. The curb opening filter in accordance with claim 1 in which said frame stiffening post includes a pair of snap fasteners for attaching said post at least one frame member.

* * * * *